US012359842B2

(12) United States Patent
Suvvada et al.

(10) Patent No.: US 12,359,842 B2
(45) Date of Patent: Jul. 15, 2025

(54) CONDENSER FAN ROTATION RESTRICTION SYSTEM

(71) Applicant: Tyco Fire & Security GmbH, Neuhausen am Rheinfall (CH)

(72) Inventors: Gnanesh Suvvada, Vizianagaram (IN); Manjur Tamboli, Norman, OK (US); Naushad Parapurath Monangat, Pune (IN); Pavankumar Ramchandra Toraskar, Sangli (IN)

(73) Assignee: Johnson Controls Light Commercial IP GmbH, Neuhausen am Rheinfall (CH)

( * ) Notice: Subject to any disclaimer, the term of this patent is extended or adjusted under 35 U.S.C. 154(b) by 0 days.

(21) Appl. No.: 18/439,574

(22) Filed: Feb. 12, 2024

(65) Prior Publication Data

US 2024/0183571 A1 Jun. 6, 2024

Related U.S. Application Data

(62) Division of application No. 17/308,645, filed on May 5, 2021, now Pat. No. 11,898,769.

(30) Foreign Application Priority Data

May 8, 2020 (IN) ..... 202011019599

(51) Int. Cl.
*F24F 13/14* (2006.01)
*F24F 11/30* (2018.01)
(Continued)

(52) U.S. Cl.
CPC ..... *F24F 13/1426* (2013.01); *F24F 11/30* (2018.01); *F24F 13/30* (2013.01); *F24F 2140/40* (2018.01)

(58) Field of Classification Search
CPC ..... F24F 13/1426; F24F 11/30; F24F 13/30; F24F 2140/40; F24F 1/16; F24F 11/871;
(Continued)

(56) References Cited

U.S. PATENT DOCUMENTS 2,841,963 A 7/1958 Schjolin et al.
3,366,167 A 1/1968 Dapper
(Continued)

FOREIGN PATENT DOCUMENTS

CN 113175440 A 7/2021
EP 0816686 A2 1/1998
(Continued)

*Primary Examiner* — Alicia M. Choi
(74) *Attorney, Agent, or Firm* — Fletcher Yoder, P.C.

(57) ABSTRACT

A condenser fan assembly includes a first condenser fan and a first motor coupled to the first condenser fan via a first shaft, where the first motor is configured to drive rotation of the first condenser fan via the first shaft, and a second condenser fan and a second motor coupled to the second condenser fan via a second shaft, where the second motor is configured to drive rotation of the second condenser fan via the second shaft. The condenser fan assembly also includes a fan rotation restrictor configured to selectively block and enable rotation of the first shaft.

9 Claims, 9 Drawing Sheets

(51) Int. Cl.
*F24F 13/30* (2006.01)
*F24F 140/40* (2018.01)

(58) Field of Classification Search
CPC ... F24F 13/14; F24F 1/38; F24F 3/153; F25B 49/027
See application file for complete search history.

(56) References Cited

U.S. PATENT DOCUMENTS 6,401,474 B1 * 6/2002 Wigglesworth ..... F24F 13/082 62/507
6,427,454 B1 * 8/2002 West ..... G05D 22/02 62/93
2007/0218828 A1 * 9/2007 Baik ..... F24F 13/075 454/325
2008/0009236 A1 1/2008 Dreher
2008/0287260 A1 11/2008 Parsons et al.
2012/0167610 A1 * 7/2012 Dunnavant ..... F28C 1/16 62/428
2018/0017063 A1 * 1/2018 Morse ..... F04D 29/325
2019/0226688 A1 * 7/2019 Dygert ..... F04D 29/667
2019/0293077 A1 * 9/2019 Brendel ..... F04D 29/668
2020/0076334 A1 3/2020 Lesniak et al.
2020/0097029 A1 3/2020 Ho et al.
2021/0018217 A1 * 1/2021 Carey ..... F24F 13/1486
2021/0123696 A1 4/2021 Johnson et al.
2021/0132640 A1 5/2021 Conry
2021/0278115 A1 9/2021 Donnellan et al.
2022/0146124 A1 * 5/2022 Tanaka ..... F24F 3/001
2023/0018836 A1 1/2023 Johnson et al.

FOREIGN PATENT DOCUMENTS

KR 100859652 B1 * 9/2008 ..... B60H 1/32
WO 2021057471 A1 4/2021

* cited by examiner

CONDENSER FAN ROTATION RESTRICTION SYSTEM

CROSS REFERENCE TO RELATED APPLICATIONS

This is a divisional application of U.S. patent application Ser. No. 17/308,645, entitled "CONDENSER FAN ROTATION RESTRICTION SYSTEM," filed May 5, 2021, which claims priority from and the benefit of India Provisional Application No. 202011019599, entitled "A SYSTEM FOR PREVENTION OF REVERSE ROTATION OF CONDENSER FANS," filed May 8, 2020, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a building, home, or other structure. The HVAC system generally includes a vapor compression system having heat exchangers, such as a condenser and an evaporator, which cooperate to transfer thermal energy between the HVAC system and the environment. Particularly, a compressor may be used to circulate a refrigerant through the vapor compression system and enable the transfer of thermal energy between the condenser and the evaporator. In many cases, a condenser fan assembly of the condenser is configured to enhance a heat transfer rate between refrigerant circulating through the condenser and an ambient environment, such as the atmosphere. For example, the condenser fan assembly may include a plurality of condenser fans that is configured to draw or force an air flow across the condenser. Accordingly, the air traversing the condenser may absorb thermal energy from the refrigerant flowing therein before the refrigerant is recirculated to, for example, the evaporator of the vapor compression system.

In some cases, one or more of the condenser fans may be deactivated during certain operational periods of the HVAC system, such as when an ambient outdoor temperature is relatively low or during a part-load operation. As a result, condenser fans remaining operational during these certain operational periods may draw a backflow of air across the non-operational fans. The backflow of air may induce rotation of the inactive fans and promote the generation of air vortices between active condenser fans and inactive condenser fans. Unfortunately, such air vortices may decrease an effectiveness of the operational condenser fans and thereby reduce an overall operational efficiency of the HVAC system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a condenser fan assembly including a first condenser fan and a first motor coupled to the first condenser fan via a first shaft, where the first motor is configured to drive rotation of the first condenser fan via the first shaft, and a second condenser fan and a second motor coupled to the second condenser fan via a second shaft, where the second motor is configured to drive rotation of the second condenser fan via the second shaft. The condenser fan assembly also includes a fan rotation restrictor having an actuator and a plunger, where the actuator is configured to adjust a position of the plunger relative to the first shaft to engage and disengage the plunger with the first shaft to selectively block rotation of the first shaft.

The present disclosure also relates to a heating, ventilation, and air conditioning (HVAC) system including a condenser and a fan deck coupled to the condenser to define a chamber between the condenser and the fan deck, where the fan deck includes a first passage and a second passage formed therein. The HVAC system also includes a first condenser fan having a first motor, where the first motor is configured to drive rotation of the first condenser fan to draw a first air flow across the condenser and discharge the first air flow from the chamber via the first passage, and a second condenser fan having a second motor, where the second motor is configured to drive rotation of the second condenser fan to draw a second air flow across the condenser and discharge the second air flow from the chamber via the second passage. The HVAC system further includes a fan rotation restrictor configured to selectively block and enable rotation of the first condenser fan and a controller communicatively coupled to the fan rotation restrictor, where the controller is configured to control operation of the fan rotation restrictor based on an operating state of the first condenser fan.

The present disclosure further relates to a condenser fan assembly having a fan shroud configured to couple to a condenser to define a chamber between the condenser and the fan shroud, where the fan shroud includes a first passage and a second passage formed therein, a first condenser fan and a first motor coupled to the first condenser fan, where the first motor is configured to drive rotation of the first condenser fan to discharge air from the chamber via the first passage, and a second condenser fan and a second motor coupled to the second condenser fan, where the second motor is configured to drive rotation of the second condenser fan to discharge air from the chamber via the second passage. The condenser fan assembly also includes a damper assembly coupled to the fan shroud, where the damper assembly is disposed about and aligned with the first passage and is disposed external to the chamber. The damper assembly includes a plurality of blades configured to transition between an open configuration and a closed configuration based on an operating state of the first condenser fan, the plurality of blades occludes the first passage in the closed configuration, and the plurality of blades exposes the first passage in the open configuration.

BRIEF DESCRIPTION OF THE DRAWINGS

Various aspects of this disclosure may be better understood upon reading the following detailed description and upon reference to the drawings in which.

DETAILED DESCRIPTION

Figure 1:
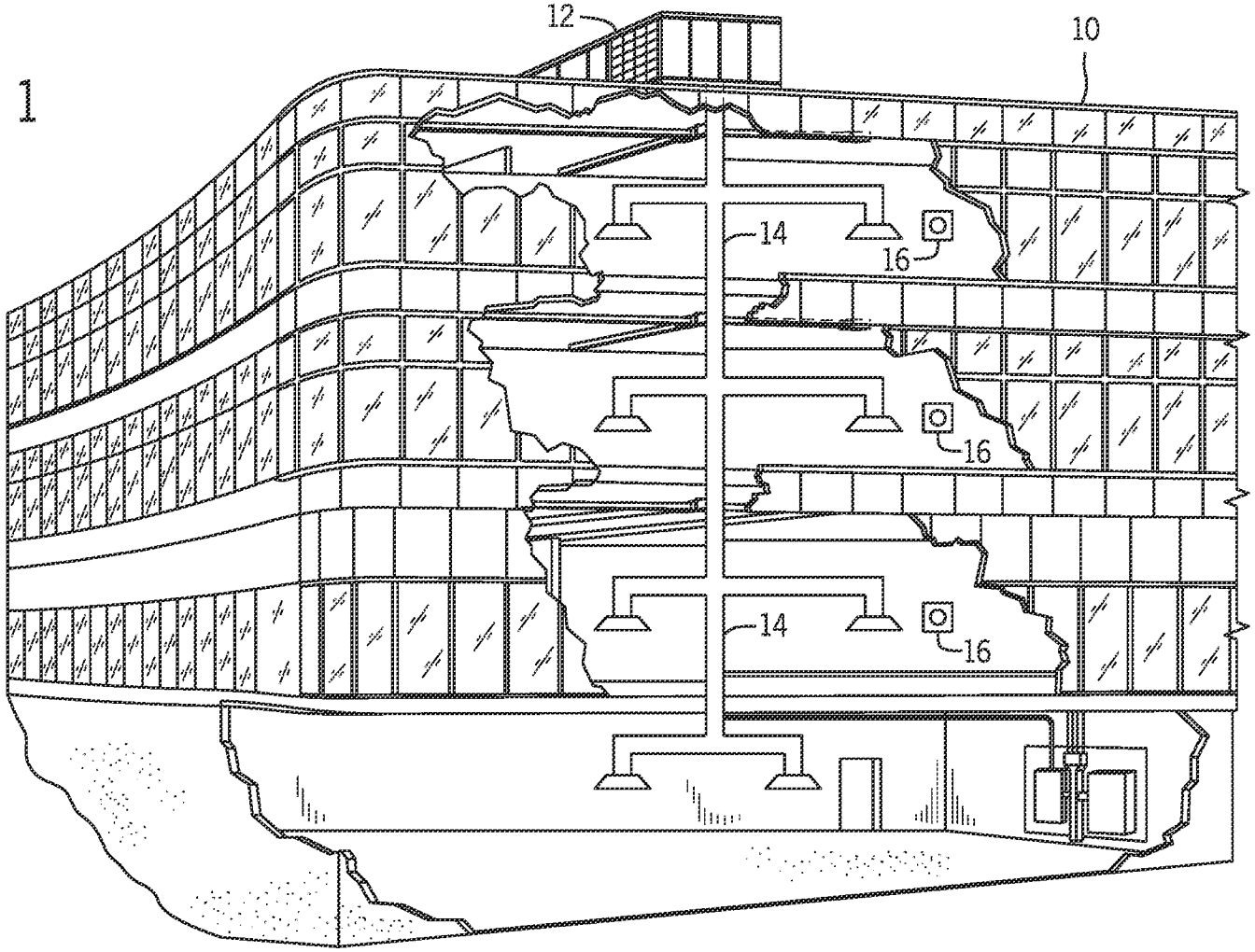
FIG. 1 is perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to thermally regulate a space within a building, home, or other suitable structure. The HVAC system generally includes a vapor compression system that transfers thermal energy between a heat transfer fluid, such as a refrigerant, and a fluid to be conditioned, such as air. The vapor compression system typically includes a condenser and an evaporator that are fluidly coupled to one another via a conduit to form a refrigerant circuit or loop. A compressor of the refrigerant circuit may be used to circulate the refrigerant through the conduit and enable the transfer of thermal energy between the condenser and the evaporator.

In many applications, a condenser fan assembly may be included with the condenser to draw or force an air flow thereacross. For example, the condenser fan assembly may include a shroud that is coupled to one or more coils of the condenser. The shroud may define one or more flow passages in fluid communication with a heat exchange area of the coils. A fan may be positioned within or adjacent to each of the flow passages and may be configured to force a flow of ambient air across the heat exchange area of the condenser coils and through the flow passages. Accordingly, the condenser fan assembly may facilitate heat transfer between refrigerant circulating through the condenser coils and an ambient environment, such as the atmosphere.

As mentioned above, one or more of the condenser fans may be deactivated during certain operational periods of the HVAC system. As an example, certain of the fans may be deactivated when a temperature of refrigerant exiting the condenser falls below a threshold value or deviates from a target range. In some embodiments, the HVAC system may suspend operation of one or more of the condenser fans during low ambient (e.g., low ambient temperature) conditions and/or during a part-load operation. Deactivating one or more of the condenser fans may decrease a rate of air flow drawn across the condenser coils, which may result in a reduction in heat transfer rate between the refrigerant flowing through the condenser coils and the ambient environment. Accordingly, a temperature of refrigerant discharged from the condenser may increase to approach the threshold value and/or remain with the designated target range.

In some cases, operational fans of the condenser fan assembly may draw a backflow of air through flow passages of the shroud that are associated with inactive or non-operating fans. That is, active fans may draw an air flow through the flow passages associated with the inactive fans in a direction that is opposite a direction of air flow passing through these flow passages during operation of the inactive fans. This backflow of air may impart a force on fan blades of the inactive fans and induce rotation of the inactive fans. Specifically, the backflow of air may cause the inactive fans to rotate in a reverse rotational direction that is opposite an operational rotational direction of the fans. The reverse rotational motion of the inactive fans may increase a flow rate of the backflow of air and, as a result, promote the generation of air vortices extending between flow passages associated with active fans and flow passages associated with inactive fans. Unfortunately, such air vortices may reduce a quantity of air that is drawn across the condenser by the active fans, which may decrease an effectiveness of the condenser fan assembly. As discussed in detail below, the reverse rotational motion of the inactive fans may additionally increase a torque load on certain components of the condenser fan assembly (e.g., a condenser fan motor) during restart of the inactive fans. In some cases, this elevated restart torque load may cause components, such as fan motors, motor bearings, etc., of the condenser fan assembly to incur wear and/or performance degradation over time. Moreover, the free-spinning reverse rotational motion of the inactive fans may hinder the use of certain types of electric motors to drive operation of the fans, such as single phase permanent split capacitor (PSC) motors.

Accordingly, embodiments of the present disclosure are directed to systems and methods for blocking reverse rotational motion of inactive condenser fans. Thus, present embodiments enable a reduction in backflow of air through flow passages associated with inactive condenser fans, reduced restart loads on components of the condenser fan assembly, extended useful lives of components of the condenser fan assembly, use of PSC motors to drive rotation of condenser fans, and increased efficiencies of the HVAC system. For example, to provide such one-way rotational motion of a condenser fan, a condenser fan assembly may include a fan rotation restriction system (e.g., fan rotation restrictor) configured to selectively engage with a motor shaft connected to the condenser fan to block rotation of the motor shaft. In some embodiments, the fan rotation restrictor includes an actuator configured to position a stopper or restrictor to be in contact with the motor shaft, such as based on an operational state of the condenser fan and/or a condenser coil associated with the condenser fan. During an operating mode of the condenser coil and/or condenser fan, the actuator may position the restrictor to be disengaged from the motor shaft to enable free rotation of the motor shaft (e.g., via operation of the motor). In a non-operating mode of the condenser coil and/or condenser fan, the actuator may position the restrictor to engage with (e.g., abut, grip, etc.) the motor shaft and block rotation of the motor shaft.

Additionally or alternatively, the fan rotation restriction system may include a damper assembly configured to block air flow through the flow passage in a direction that is opposite a direction of air flow passing through the flow passage during operation of the inactive fan. For example, the damper assembly may include a backdrop damper configured to transition to an open position in response to the condenser fan operating (e.g., rotating) to force air flow through the flow passage and transition (e.g., automatically transition) to a closed position in response to non-operation of the condenser fan. In the open position, the backdrop damper exposes the flow passage and enables air flow generated via operation of the condenser fan to flow through the flow passage, and in the closed position the backdrop damper occludes the flow passage to block air flow (e.g., backflow) from flowing through the flow passage in a direction that is opposite the direction of air flow passing through the flow passage during operation of the condenser fan. In other embodiments, the damper assembly may include an actuator configured to adjust a position of the damper assembly, such as based on an operational state of the condenser fan and/or a condenser coil associated with the condenser fan.

In this manner, embodiments of the fan rotation restriction system disclosed herein mitigate the aforementioned shortcomings of conventional condenser fan assemblies. These and other features will be described below with reference to the drawings. Further, it is important to note that, while the present disclosure describes the fan rotation restriction system as configured for use with a condenser fan, it should be appreciated that the disclosed embodiments may be implemented with a variety of other fans, ventilators, pumps, and/or compressors. For example, the techniques described herein may be used with evaporator fans, furnace ventilators, heating coil fans, or any other suitable flow generating devices in order to permit rotational motion of a fan, rotor, and/or impeller of these devices in a particular direction, while blocking rotational motion in an opposite direction.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by an HVAC system 11 having an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
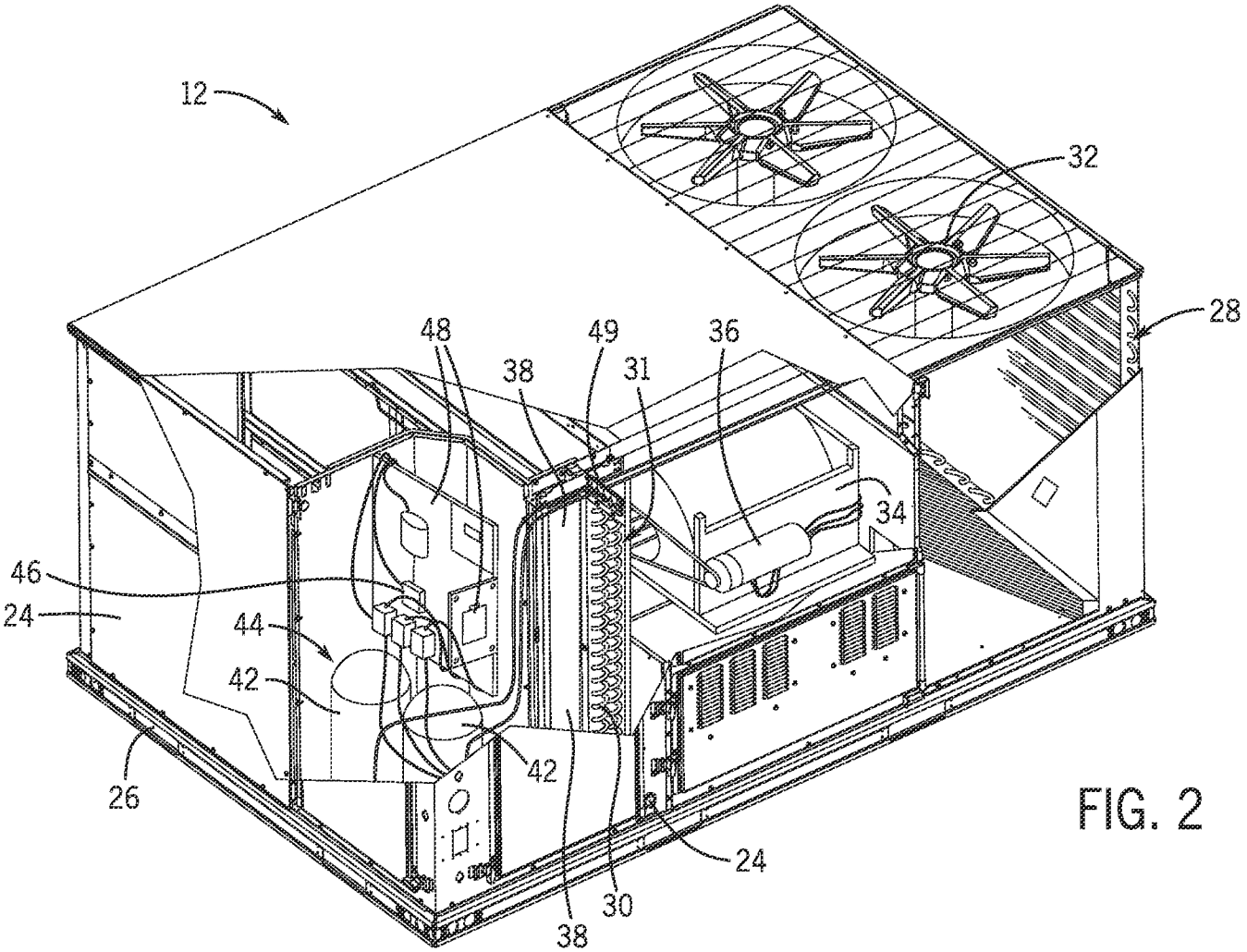
FIG. 2 is a perspective view of an embodiment of a packaged HVAC unit, in accordance with an aspect of the present disclosure.

FIG. 2 is a perspective view of an embodiment of the HVAC unit 12 that includes a flash gas bypass system in accordance with present embodiments. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
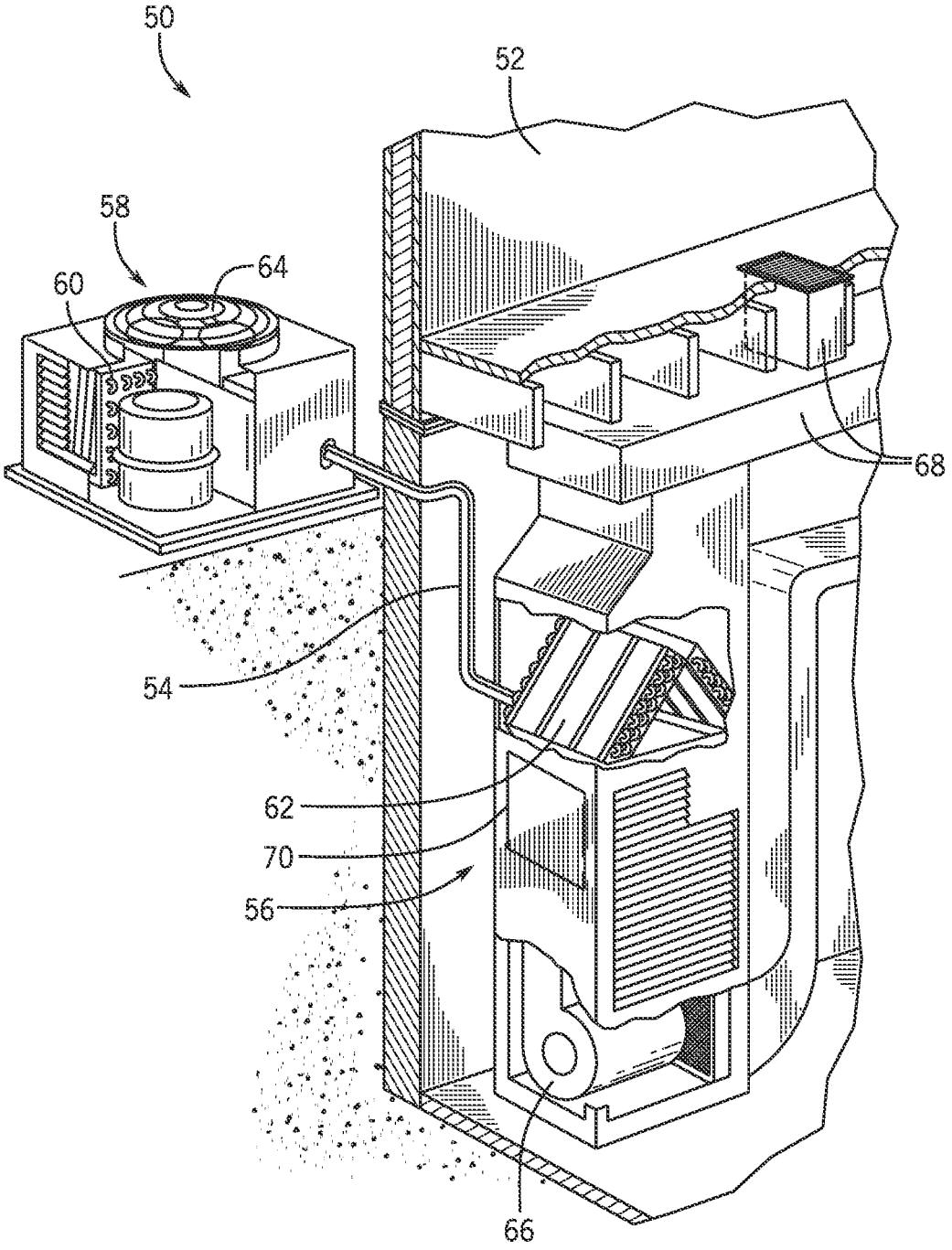
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
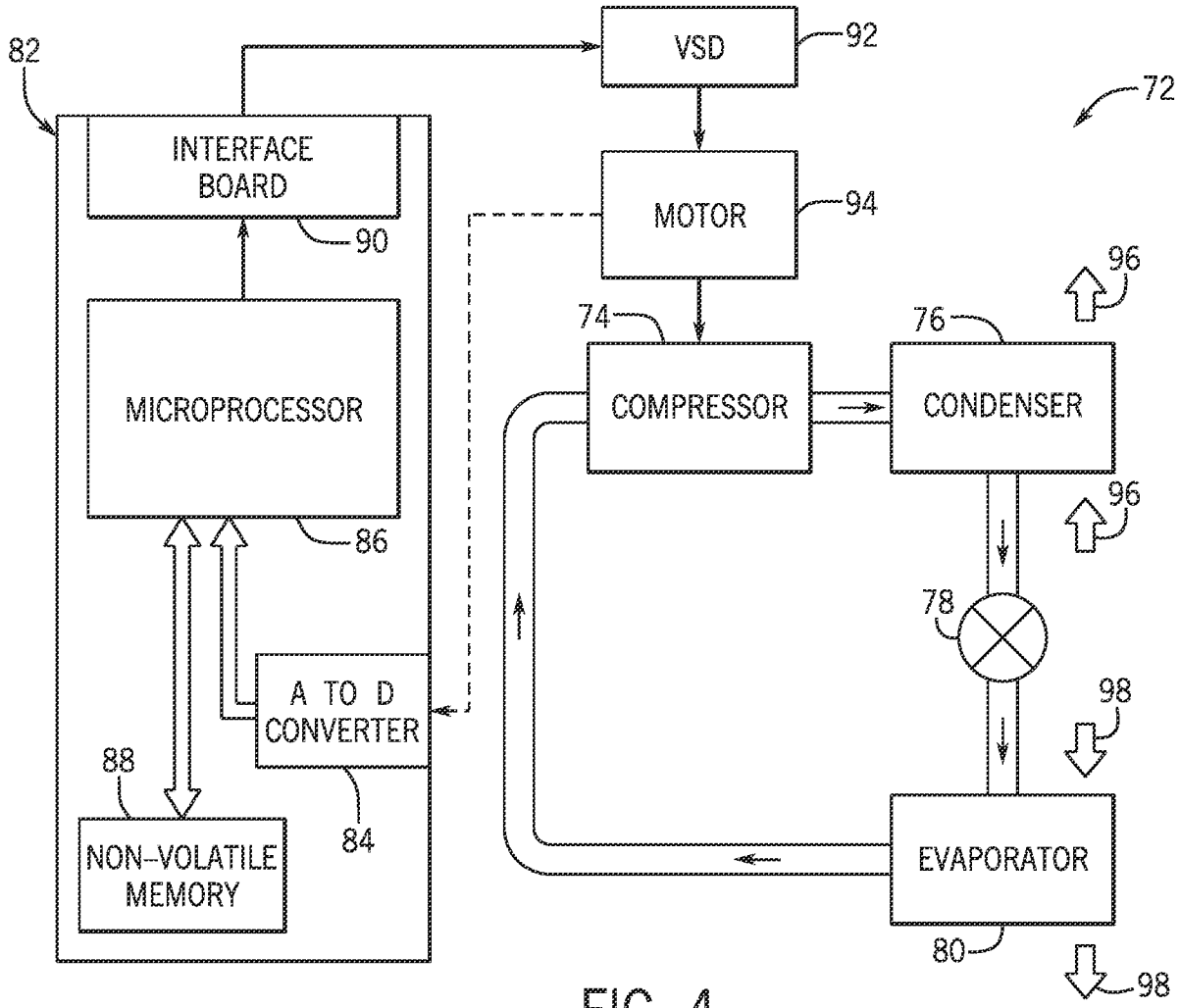
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
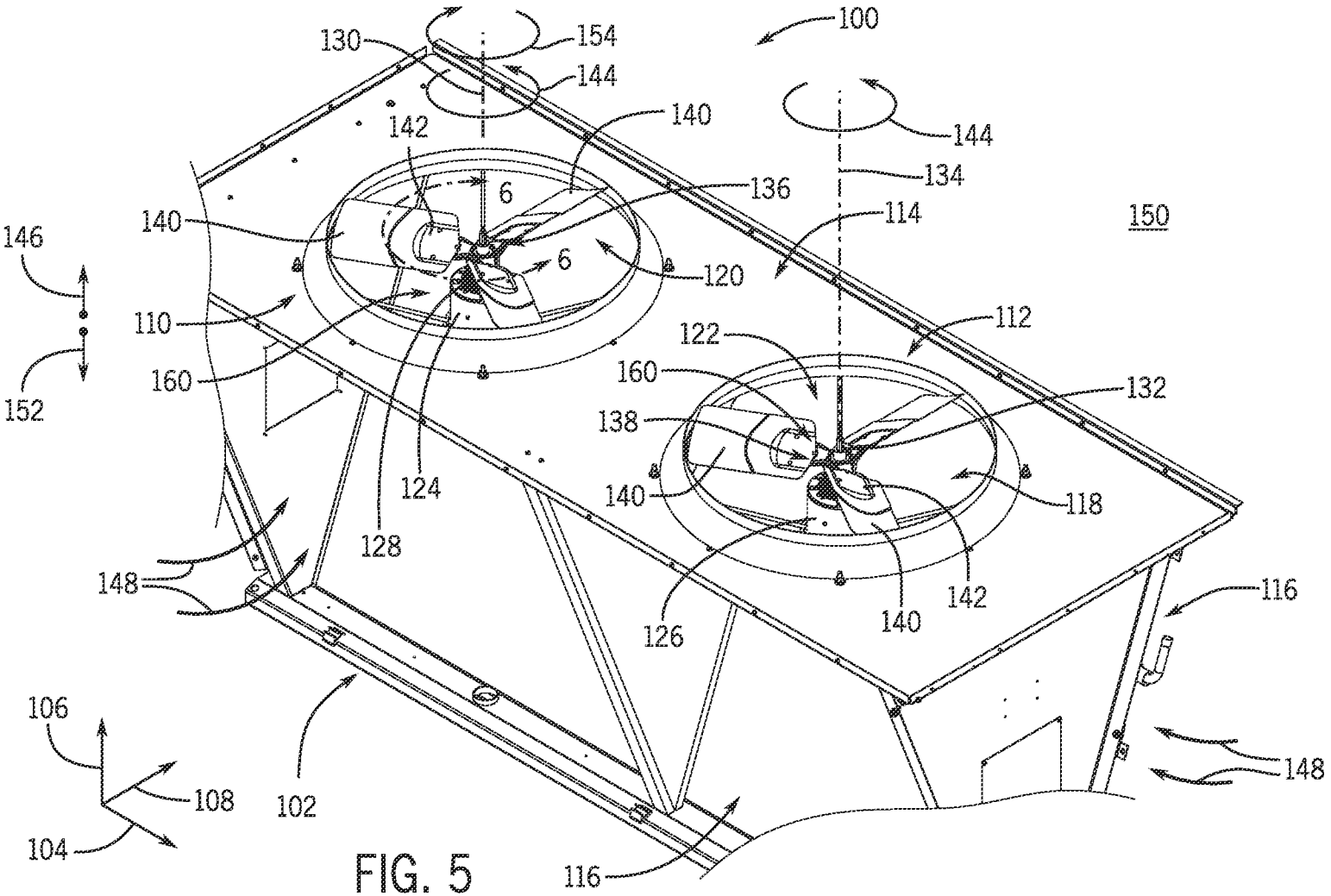
FIG. 5 is a perspective view of an embodiment of a condenser fan assembly having a fan rotation restriction system, in accordance with an aspect of the present disclosure.

As mentioned above, HVAC systems may include a fan assembly or a fan array including one or more fans that are configured to direct an air flow across certain components of the HVAC system, such as the heat exchangers 28, 30, the condenser 76, and/or the evaporator 80. For instance, FIG. 5 is a perspective view of an embodiment of a condenser fan assembly 100 that may be used to direct a flow of ambient air across a condenser 102. The condenser fan assembly 100 may be included in embodiments or components of the HVAC unit 12 shown in FIG. 1, embodiments or components of the split residential heating and cooling system 50 shown in FIG. 3, a rooftop unit (RTU), or any other suitable HVAC system. To facilitate discussion, the condenser fan assembly 100 and its components will be described with reference to a longitudinal axis 104, a vertical axis 106, and a lateral axis 108. In the illustrated embodiment, the condenser fan assembly 100 includes a first condenser fan 110 (e.g., first condenser fan assembly) and a second condenser fan 112 (e.g., second condenser fan assembly) that are coupled to a shroud 114 (e.g., a fan deck, a fan shroud, etc.). As discussed in detail below, the shroud 114 extends between condenser coils 116 of the condenser 102 to define a space, referred to herein as a chamber 118, between the condenser coils 116 and the shroud 114. In some embodiments, the shroud 114 may include a portion of the HVAC unit 12 and/or include a support structure of the HVAC unit 12.

The first condenser fan 110 and the second condenser fan 112 are positioned within a first passage 120 (e.g., first flow passage) and a second passage 122 (e.g., second flow passage), respectively, defined within the shroud 114. The first condenser fan 110 and the second condenser fan 112 include a first motor 124 and a second motor 126, respectively, which may be coupled to the condenser 102, the shroud 114, and/or to another structural component, such as via respective motor mounts. The motor mounts may be configured to concentrically and/or coaxially align a shaft 128 of the first motor 124 with a first centerline 130 of the first passage 120 and concentrically and/or coaxially align a shaft 132 of the second motor 126 with a second centerline 134 of the second passage 122. The shafts 128, 132 are respectively coupled to a first rotor 136 of the first condenser fan 110 and a second rotor 138 of the second condenser fan 112. Specifically, the first and second rotors 136, 138 each include a plurality of angled fan blades 140 that extend radially from a respective fan blade base 142 coupled to the shafts 128, 132. The motors 124, 126 include internal drive components, such as a rotor and stator assembly, which are operable to impart a torque to the shafts 128, 132 to drive rotation of the shafts 128, 132 and the rotors 136, 138 about the centerlines 130, 134. Particularly, the first motor 124 may rotate the first rotor 136 about the first centerline 130, while the second motor 126 rotates the second rotor 138 about the second centerline 134. Accordingly, the fan blades 140 may engage with air surrounding the first and second rotors 136, 138 to force the air along and through the first and second passages 120, 122. As described below, the first and second condenser fans 110, 112 may include additional components, such as variable speed drives (VSDs) configured to enable variable operation (e.g., variable speeds) of the first and second condenser fans 110, 112.

For example, in some embodiments, the motors 124, 126 may be configured to respectively rotate the first and second rotors 136, 138 in a counterclockwise direction 144 about the first and second centerlines 130, 134. In certain embodiments, counterclockwise rotation of the rotors 136, 138 may enable the fan blades 140 to force air along and through the passages 120, 122 a first direction 146 along the vertical axis 106. Accordingly, the first and second condenser fans 110, 112 may generate a region of relatively low pressure within the chamber 118 that may be less than an ambient atmospheric pressure surrounding the chamber 118. As a result, the pressure difference may force higher pressure ambient air across a heat exchange area the condenser coils 116 and into the chamber 118, as indicated by arrows 148. In this manner, the first and second condenser fans 110, 112 may draw a flow of ambient air across the condenser 102 and, thus, enable the ambient air to absorb thermal energy from a refrigerant circulating through the condenser coils 116. The condenser fans 110, 112 may discharge the ambient air within the chamber 118 through the first and second passages 120, 122 as heated exhaust air. Accordingly, the condenser fan assembly 100 may facilitate heat exchange between the refrigerant circulating through the condenser 102 and an ambient environment 150. Although two condenser fans 110, 112 are shown in the illustrated embodiment, it should be noted that in other embodiments, the condenser fan assembly 100 may include any suitable quantity of condenser fans 110, 112. As an example, the condenser fan assembly 100 may include 1, 2, 3, 4, 5, 6, or more than six condenser fans that are positioned within or adjacent to respective passages of the shroud 114.

With the foregoing in mind, in some embodiments, a temperature of refrigerant discharging from the condenser 102 may drop below a target value or decrease below a target operating range of values. As an example, such an operating condition may occur when a temperature of the ambient environment 150 surrounding the condenser fan assembly 100 is relatively low. In such cases, directing ambient air across the condenser 102 via both the first and second condenser fans 110, 112 may enable the cool ambient air to absorb a relatively large amount of thermal energy from refrigerant circulating through the condenser 102 and, thus, cause a discharge temperature of the refrigerant to decrease below a desired target temperature or target range. Accordingly, to increase the refrigerant discharge temperature, a controller of the condenser fan assembly 100 (e.g., the control device 16, control board 48, control panel 82, and/or another suitable control system of an HVAC system having the condenser fan assembly 100) may generate a command or control signal to temporarily suspend operation the first condenser fan 110 or the second condenser fan 112. In this way, a flow rate of ambient air directed across the condenser 102 may be reduced, thereby reducing a rate of heat transfer between the refrigerant and the ambient environment 150 and enabling an increase in a temperature of refrigerant discharging from the condenser 102.

For example, in some embodiments, a controller may send a command or control signal to deactivate the first condenser fan 110 upon receiving an indication that a discharge temperature of refrigerant exiting the condenser 102 is below the target temperature and/or upon a determination that a temperature of the ambient environment 150 is at or below a threshold temperature. In other embodiments, a controller may send a control signal to deactivate the first condenser fan 110 during a part-load operation of an HVAC system having the condenser fan assembly 100. With operation of the first condenser fan 110 suspended, the second condenser fan 112 may remain operational to draw ambient air across the condenser 102 and into the chamber 118. As noted above, operation of the second condenser fan 112 may decrease a pressure within the chamber 118 below a pressure of the ambient environment 150, which may force ambient air into the chamber 118 via the first passage 120 associated with the inactive first condenser fan 110. Specifically, air from the ambient environment 150 may flow through the first passage 120 in a second direction 152 that is substantially opposite the first direction 146. Throughout the following discussion, such air flowing through the first passage 120 in the second direction 152 will be referred to herein as "backflow air."

The backflow air may engage with the fan blades 140 of the first condenser fan 110 and impart a force on the first rotor 136 that may be sufficient to rotate the first rotor 136 about the first centerline 130 in a clockwise direction 154. In other words, the backflow air may induce rotation of the first rotor 136 in a direction that is opposite a rotational direction of the first rotor 136 during normal operation of the first condenser fan 110. Generally, such rotation of the first rotor 136 may reduce fluidic restrictions along the first passage 120 and promote the flow of backflow air through the first passage 120 and into the chamber 118 in the second direction 152. Indeed, rotation of the first rotor 136 in the clockwise direction 154 may force air into the chamber 118. In some embodiments, the counter rotational motion of the non-operational first condenser fan 110 and the operational second condenser fan 112 may generate a vortex of backflow air that may continuously recirculate through the first passage 120 and the second passage 122. That is, backflow air entering the chamber 118 via the first passage 120 may be drawn into the second passage 122 by the second condenser fan 112, discharged through the second passage 122 in the first direction 146, and subsequently recirculated to the first passage 120 by the first condenser fan 110. Unfortunately, this vortex or circulation of backflow air may bypass the heat exchange area of the condenser coils 116 and reduce an amount of ambient air that is drawn across the condenser 102 by the second condenser fan 112. The recirculation of backflow air between the first and second condenser fans 110, 112 may reduce an effectiveness of the second condenser fan 112, and thus, reduce an operational efficiency of the condenser fan assembly 100.

Additionally, the induced clockwise rotational motion of the first rotor 136 may increase a strain on the first motor 124 when the first condenser fan 110 is re-activated to resume normal operation. For example, upon receiving a command from a controller to restart operation, the first motor 124 initially overcomes the rotational inertia of the first rotor 136 to discontinue the clockwise rotational motion of the first rotor 136 before initiating rotation of the first rotor 136 in the counterclockwise direction 144. In some embodiments, reversing the rotational direction of the first rotor 136 in this manner may impart strain or loading on the shaft 128 of the first motor 124 and/or internal components of the first motor 124 which, in some cases, may cause the first motor 124 to incur wear or performance degradation.

Moreover, the induced clockwise rotational motion of the first condenser fan 110 may hinder the use of certain types of electric motors to drive rotation the first condenser fan 110, such as relatively low cost single phase permanent split capacitor (PSC) motors. For example, when activated, a single phase PSC motor generally initiates rotation in a particular direction based on a current rotational direction of the motor. That is, a single phase PSC motor having a shaft that is already rotating in a particular rotational direction before receiving a command for activation will typically begin driving rotation of the shaft in that same rotational direction. Accordingly, using a single phase PSC motor as the first motor 124 may cause the first motor 124 to continue rotating the first rotor 136 in the clockwise direction 154 upon receiving a command to reactivate. In other words, upon receiving an indication from a controller to restart operation, the first motor 124 may continue to rotate the first rotor 136 in the clockwise direction 154, and thus, direct a flow of air into, rather than out of, the chamber 118.

Accordingly, embodiments of the present disclosure are directed toward a fan rotation restriction system 160, also referred to herein as a fan rotation restrictor, which is configured to block undesired rotational motion of a condenser fan, such as during non-operational periods of the condenser fan. The first condenser fan 110 and the second condenser fan 112 may each include the fan rotation restriction system 160. That is, one fan rotation restriction system 160 may be incorporated with the first condenser fan 110, and another fan rotation restriction system 160 may be incorporated with the second condenser fan 110. The fan rotation restriction system 160 may have various elements and configurations, as described below. For example, the fan rotation restriction system 160 associated with the first condenser fan 110 may be configured to selectively engage with the first shaft 128 to block undesired rotation of the first rotor 136. In additional or alternative embodiments, the fan rotation restriction system 160 may be configured to block or occlude the first passage 120 to block air flow therethrough and mitigate undesired rotation of the first rotor 136. In any case, the fan rotation restriction system 160 is configured to selectively block undesired rotation of a condenser fan (e.g., condenser fans 110, 112), such as rotation of a condenser fan in the clockwise direction 154. In this manner, the fan rotation restriction system 160 may prevent, mitigate, or substantially reduce occurrence of the aforementioned shortcomings of typical condenser fan assemblies.

Figure 6:
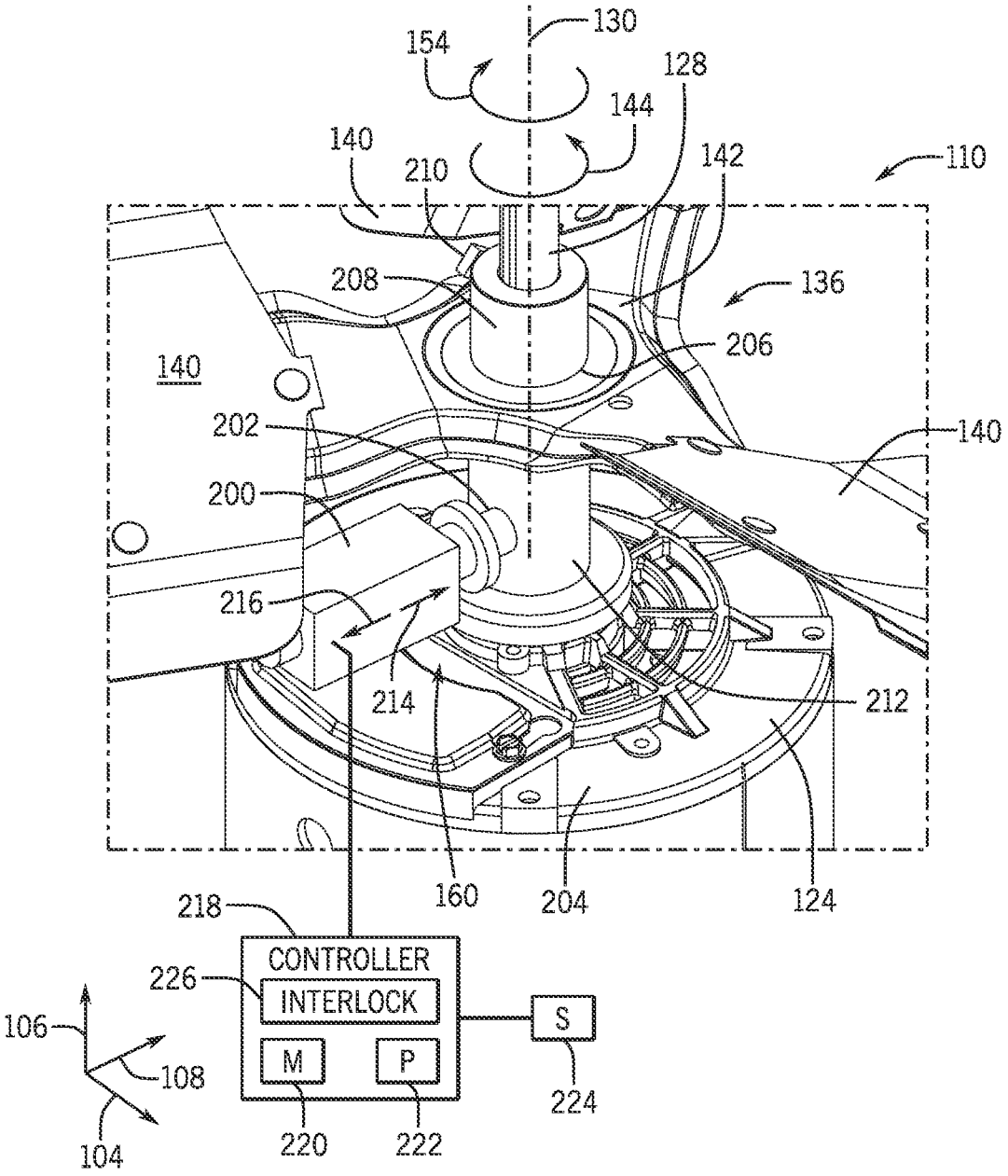
FIG. 6 is an expanded perspective view, taken within line 6-6 of FIG. 5, illustrating an embodiment of a condenser fan having a fan rotation restriction system, in accordance with an aspect of the present disclosure.

With the foregoing in mind, FIG. 6 is an expanded perspective view, taken within line 6-6 of FIG. 5, of the first condenser fan 110, illustrating an embodiment of the fan rotation restriction system 160 incorporated with the first condenser fan 110. As noted above, the second condenser fan 112 may also include an embodiment of the fan rotation restriction system 160, which may be similar to the fan rotation restriction system 160 of the illustrated embodiment and may operate in a manner similar to that described herein. In the present embodiment, the fan rotation restriction system 160 is configured to selectively engage with the shaft 128 of the first motor 124 to selectively block rotation of the first rotor 136 (e.g., in the clockwise direction 154).

As shown, the fan rotation restriction system 160 includes an actuator 200 and a plunger 202 (e.g., restrictor, solenoid plunger, piston, etc.). The actuator 200 is configured to adjust a position of the plunger 202 to enable selective engagement (e.g., contact) between the plunger 202 and the shaft 128 of the first motor 124. For example, the actuator 200 may be a solenoid, electrical actuator, electromechanical actuator, magnetic actuator, pneumatic actuator, or another other suitable actuation mechanism configured to adjustably position the plunger 202 relative to the shaft 128. The plunger 202 may include a rod, pin, mechanical linkage, or other element configured to engage (e.g., abut) and disengage with the shaft 128. In other embodiments, the plunger 202 (e.g., restrictor) may be a clamp, sleeve, grip, or other element or mechanism configured to selectively engage with (e.g., physically engage with) the shaft 128 to restrict rotational motion of the shaft 128. In the illustrated embodiment, the actuator 200 and the plunger 202, which may be referred to collectively as a restrictor, are disposed external to the first motor 124. In particular, the actuator 200 is coupled to an exterior of a housing (e.g., external housing) 204 of the first motor 124. However, as described below with reference to FIG. 7, in other embodiments the actuator 200 and plunger 202 may be disposed internal to the first motor 124 (e.g., the housing 204).

As described in detail above, the shaft 128 of the first motor 124 is coupled to the first rotor 136, such that rotational motion generated by the first motor 124 may be transferred to the first rotor 136 via the shaft 128. The shaft 128 extends from the first motor 124 along the first centerline 130. The shaft 128 extends through an opening 206 of the first rotor 136, such that the first rotor 136 extends circumferentially about the shaft 128. The shaft 128 also extends through a retainer 208 (e.g., cylindrical retainer, annular retainer) disposed circumferentially about the shaft 128 and positioned above the first rotor 136 (e.g., along the vertical axis 106, relative to gravity). The retainer 208 may be secured to the shaft 128 in order to retain the first rotor 136 on and/or about the shaft 128. For example, the retainer 208 may include a fastener 210 (e.g., screw, pin, etc.) configured to extend through the retainer 208 and engage with the shaft 128 (e.g., extend into a groove formed in the shaft 128). In this way, the retainer 208 may be rotationally fixed with the shaft 128, such that the shaft 128 and retainer 208 rotate with one another.

The shaft 128 also includes a sleeve 212 (e.g., a tube, an annulus, etc.) disposed circumferentially about the shaft 128. The sleeve 212 is positioned beneath the first rotor 136 (e.g., along the vertical axis 106, relative to gravity) and may also be rotationally fixed to the shaft 128, such that the shaft 128 and the sleeve 212 rotate with one another and/or do not rotate relative to one another. Thus, in some embodiments, the first rotor 136 may be captured between the sleeve 212 and the retainer 208 (e.g., along the vertical axis 106). The sleeve 212 may be a component of the fan rotation restriction system 160 and may be configured to cooperatively function with the actuator 200 and/or the plunger 202 to selectively block rotation of the shaft 128. For example, the sleeve 212 may be formed from rubber, silicone, another polymer or elastomeric material, or any other suitable material (e.g., ductile material). In some embodiments, the sleeve 212 is secured (e.g., rotationally secured) to the shaft 128 via fasteners, clamps, adhesives, or other features. In other embodiments, the respective materials of the sleeve 212 and the shaft 128 may enable or provide the rotationally fixed securement (e.g., friction) between the sleeve 212 and the shaft 128. In any case, the sleeve 212 may be secured to the shaft 128 such that no clearance between the shaft 128 and sleeve 212 is provided therebetween.

In operation, the actuator 200 may adjust a position of the plunger 202 to cause the plunger 202 to extend in a direction 214 (e.g., in a radially inward direction relative to the first centerline 130) towards the shaft 128. For example, the actuator 200 may be a normally "open" or disengaged actuator 200. In other words, the actuator 200 may retain the plunger 202 in a configuration disengaged from the sleeve 212 and the shaft 128 until the actuator 200 receives a signal (e.g., electrical signal, control signal, etc.) to actuate and adjust the position of the plunger 202 in the direction 214. Upon receiving the signal, the actuator 200 transitions the plunger 202 in the direction 214 to contact the sleeve 212 (e.g., in an engaged configuration), which extends about and is rotationally fixed to the shaft 128. With the plunger 202 in contact with and abutting the sleeve 212, the plunger 202 may block rotation of the shaft 128 (e.g., via friction created between the plunger 202 and the sleeve 212). In some embodiments, the actuator 200 may be configured to apply a biasing force to the plunger 202, and the plunger 202 may transfer the biasing force to the sleeve 212 in order to create friction between the plunger 202 and the sleeve 212 to effectively block rotation of the shaft 128. In some embodiments, the actuator 200 may be configured to provide feedback indicated of an amount of force applied by the plunger 202 to the sleeve 212. In such embodiments, operation of the actuator 200 may be adjusted based on the feedback. As will be appreciated, the sleeve 212, which may be formed from rubber or other elastic or pliable material, may deform and/or absorb the biasing force applied by the plunger 202. In this way, the sleeve 212 may protect the shaft 128 while also enabling creation of friction between the sleeve 212 and the plunger 202 to block rotation of the shaft 128.

To enable rotation (e.g., free rotation) of the shaft 128 and thus the first rotor 136, the actuator 200 may operate to withdraw the plunger 202 from engagement with the sleeve 212 by adjusting the position of the plunger 202 in a direction 216 opposite direction 214. With the plunger 202 disengaged from the sleeve 212 (e.g., in a disengaged configuration), the rotation of the shaft 128 (e.g., via the first motor 124) is enabled.

As mentioned above, the fan rotation restriction system 160 may operate based on control signals from a controller 218. For example, the controller 218 may be a separate or standalone controller, the control device 16, control board 48, control panel 82, and/or another suitable control system of an HVAC system (e.g., HVAC unit 12) having the condenser fan assembly 100. The controller 218 includes a memory 220 and processing circuitry 222. The memory 220 may include a tangible, non-transitory, computer-readable medium that may store instructions that, when executed by the processing circuitry 222, may cause the processing circuitry 222 to perform various functions described herein. To this end, the processing circuitry 222 may be any suitable type of computer processor or microprocessor capable of executing computer-executable code, including but not limited to one or more field programmable gate arrays (FPGA), application-specific integrated circuits (ASIC), programmable logic devices (PLD), programmable logic arrays (PLA), and the like.

In some embodiments, the controller 218 may control operation of the fan rotation restriction system 160 based on an operating mode or operational state of an HVAC system (e.g., HVAC unit 12) having the condenser fan assembly 100 with the first condenser fan 110 and the second condenser fan 112. For example, the controller 218 may control the fan rotation restriction system 160 based on an operational state of the condenser fans 110, 112, the condenser 102, and/or other components of the HVAC system (e.g., vapor compression system 72). As mentioned above, the condenser 102 includes condenser coils 116 configured to circulate refrigerant therethrough. In some embodiments, the condenser 102 may be associated with multiple refrigerant circuits of the HVAC system. For example, certain condenser coils 116 may be components of a first refrigerant circuit, and other condenser coils 116 may be components of a second refrigerant circuit that is fluidly separate from the first refrigerant circuit. However, in other embodiments, the condenser coils 116 of the condenser 102 may be part of a common refrigerant circuit.

In certain operational modes of the HVAC system having the condenser 102, it may be desirable to suspend operation of one or more of the condenser fans 110, 112, such as during a part-load operation, during low ambient conditions, and so forth. For example, in an embodiment of the condenser 102 having condenser coils 116 associated with different refrigerant circuits (e.g., a multi-circuit HVAC system), operation of one of the refrigerant circuits (e.g., vapor compression system 72) may be suspended while operation of another refrigerant circuit is initiated and/or maintained. In such circumstances, operation of the condenser fan(s) 110, 112 associated with the inactive or non-operating refrigerant circuit (e.g., associated with the condenser coil(s) 116 of the inactive or non-operating refrigerant circuit) may be suspended, and the fan rotation restriction system 160 may be utilized to block rotation of the inactive or non-operating condenser fan(s) 110, 112. For example, in the illustrated embodiment, the first condenser fan 110 may be associated with a first refrigerant circuit (e.g., vapor compression system 72) of the HVAC system. When operation of the first refrigerant circuit is suspended (e.g., a compressor of the first refrigerant circuit is deactivated), the first motor 124 may be deactivated to suspend operation of the first condenser fan 110. Thus, the first condenser fan 110 does not operate to force air flow across the condenser coils 116 associated with the first refrigerant circuit. In other words, the first refrigerant circuit and the first condenser fan 110 are in an inactive or non-operating state.

Based on the inactive or non-operating state of the first condenser fan 110, the controller 218 may control the actuator 200 to position the plunger 202 (e.g., actuate the plunger 202 in the direction 214) in abutment or engagement with the sleeve 212 of the shaft 128. For example, the controller 218 may determine that the first refrigerant circuit and/or the first condenser fan 110 are in the inactive or non-operating state based on a signal (e.g., control signal, status signal, etc.) received from another controller (e.g., control board 48, control panel 82), based on a signal output by the controller 218 (e.g., a control signal to deactivate the first motor 124), and/or based on another communication or determination. In some embodiments, the controller 218 may be configured to determine that the first refrigerant circuit and/or the first condenser fan 110 are in the inactive or non-operating state based on feedback received from a sensor 224 (e.g., received by controller 218 and/or received by another controller, such as a controller of the first condenser fan 110), which may be any sensor of the HVAC system having the condenser fan assembly 100. For example, the sensor 224 may be configured to provide feedback indicative of a temperature of the ambient environment 150, an amount of air flow flowing through the first passage 120, a current draw of the first motor 124, a rotational speed of the first condenser fan 110 or a component thereof, an operating state of a compressor of the first refrigerant circuit, any other suitable feedback indicative of an operating state of the condenser 102 or HVAC system, or any combination thereof.

Based on the determination that the first condenser fan 110 is in and/or is transitioning to the inactive or non-operating state, the controller 218 may output a control signal to the actuator 200 to adjust the plunger 202 and position (e.g., bias) the plunger 202 against the sleeve 212 and the shaft 128. Thus, the controller 218 may be configured to operate the actuator 200 and plunger 202 to block rotation of the shaft 128 after operation of the first condenser fan 110 is suspended or during concurrent suspension of operation of the first condenser fan 110. For example, the controller 218 may not operate the actuator 200 to create engagement between the plunger 202 and the sleeve 212 and the shaft 128 until suspended operation of the first condenser fan 110 (e.g., the first motor 124) is determined or initiated. To this end, the controller 218 includes an interlock 226 (e.g., electrical interlock, interlock circuitry, interlock algorithm, etc.). As will be appreciated, the interlock 226 enables coordinated operation of the first condenser fan 110 (e.g., first motor 124) and the fan rotation restriction system 160. Specifically, the interlock 226 to configured to operate to ensure that the fan rotation restriction system 160 is not in the engaged configuration during operation of the first condenser fan 110 (e.g., first motor 124). For example, the interlock 226 may be communicatively coupled to control circuitry (e.g., control board 48) configured to regulate operation of the first motor 124.

The interlock 226 may also operate to block activation of the first motor 124 (e.g., transition from an inactive or non-operating state to an active or operating state) when the fan rotation restriction system 160 is in the engaged configuration. For example, upon a determination that reactivation of the first condenser fan 110 is desired (e.g., in response to a signal to transition the first condenser fan 110 from a non-operating state to an operating state), the controller 218 may output a control signal to the actuator 200 to adjust the plunger 202 and disengage the plunger 202 from the sleeve 212 and the shaft 128. Based on a determination (e.g., by the interlock 226) that the fan rotation restriction system 160 is in the disengaged configuration, the controller 218 may output a signal to the first motor 124 and/or to a controller of the first condenser fan 110 to enable activation of the first condenser fan 110. Thus, via operation of the interlock 226, operation of fan rotation restriction system 160 (e.g., the actuator 200) and the first condenser fan 110 (e.g., the first motor 124) is coordinated and dependent on one another. In this way, inadvertent or undesired engagement between the plunger 202 and the sleeve 212 and the shaft 128 is avoided.

Figure 7:
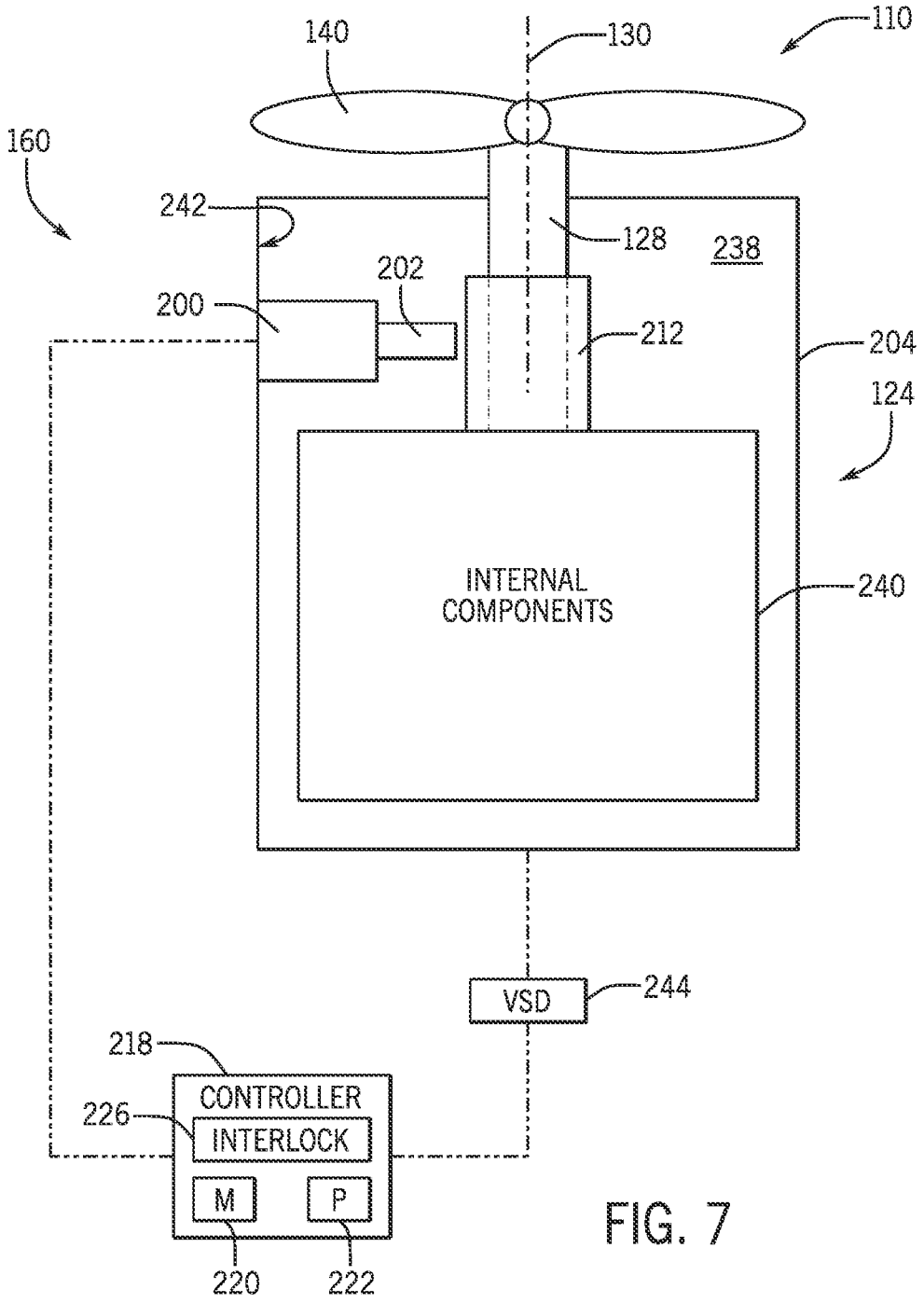
FIG. 7 is a schematic of an embodiment of a condenser fan assembly having a fan rotation restriction system, in accordance with an aspect of the present disclosure.

FIG. 7 is a schematic of an embodiment of the first condenser fan 110 (e.g., condenser fan assembly) having the fan rotation restriction system 160. The illustrated embodiment includes similar elements and element numbers as the embodiment described above with reference to FIG. 6, and the fan rotation restriction system 160 is configured to operate similar to the manner described above. However, in the illustrated embodiment, the actuator 200 and the plunger 202 are disposed internal to the housing 204 of the first motor 124. The housing 204 may be a case, shell, or other enclosure defining an interior 238 (e.g., interior volume) in which internal components 240 of the first motor 124 may be disposed. For example, the internal components 240 may include a core, stator, rotor, windings, bearings, and/or other components configured to generate rotational motion and transfer rotational motion to the shaft 128, which extends from the internal components 240, through the housing 204, and to an exterior of the housing 204.

The actuator 200 and the plunger 202 may have any suitable arrangement within the interior 238 of the housing 204. For example, the actuator 200 may be mounted to secured to an interior surface 242 of the housing 204. In other embodiments, the actuator 200 may be mounted or attached to one or more of the internal components 240. As similarly described above, the actuator 200 and the plunger 202 are arranged such that the plunger 202 extends from the actuator 200 toward the shaft 128 (e.g., toward the first centerline 130). Thus, the actuator 200 may adjust a position of the plunger 202 to enable engagement between the plunger 202 and the sleeve 212 of the shaft 128 and disengagement of the plunger 202 from the sleeve 212 of the shaft 128 (e.g., within the interior 238 of the housing 204).

The controller 218, which is communicatively coupled to the actuator 200, may be disposed external to the housing 204 of the first motor 124, as shown, or the controller 218 may be disposed internal to the housing 204. In the illustrated embodiment, the controller 218 is also communicatively coupled to a variable speed drive (VSD) 244 configured to enable variable operation (e.g., variable speeds) of the first motor 124. As with the controller 218, the VSD 244 may be disposed external to the housing 204. For example, the controller 218 and the VSD 244 may be located within a control section or enclosure of an HVAC unit having the first condenser fan 110.

Figure 8:
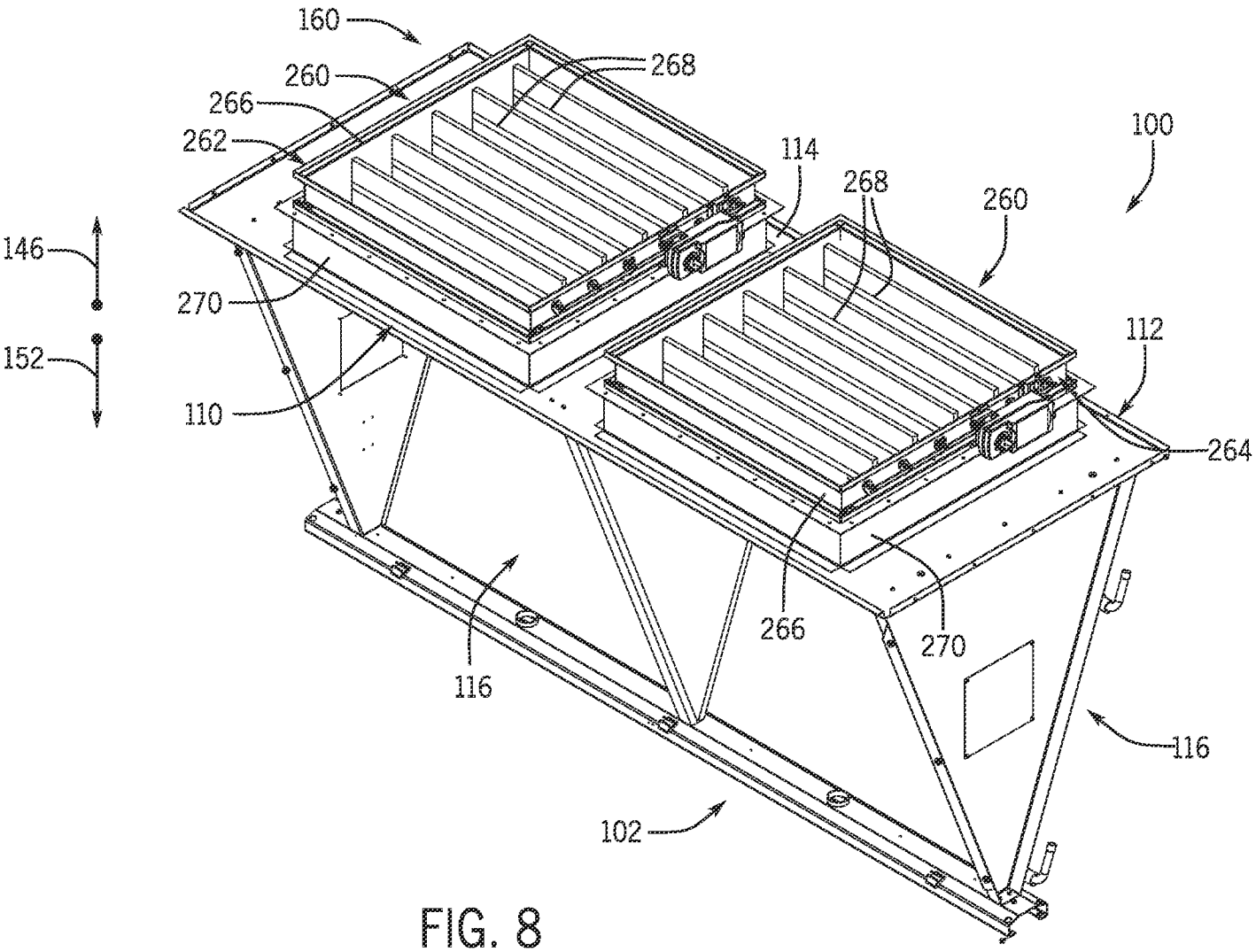
FIG. 8 is a perspective view of an embodiment of a condenser fan assembly having a fan rotation restriction system, in accordance with an aspect of the present disclosure.

FIG. 8 is a perspective view of an embodiment of the condenser fan assembly 100 including the fan rotation restriction system 160. The condenser fan assembly 100 includes similar elements and element numbers as the embodiment of the condenser fan assembly 100 described above with reference to FIG. 5, such as the condenser 102, shroud 114, condenser coils 116, and so forth. Although not visible, the illustrated condenser fan assembly 100 also includes the first condenser fan 110, second condenser fan 112, first passage 120, and second passage 122, among other similar elements.

The fan rotation restriction system 160 in the illustrated embodiment includes a damper assembly 260, which may be incorporated instead of or in addition to the restrictor (e.g., actuator 200 and plunger 202) discussed above. More specifically, two damper assemblies 260 are included with the condenser fan assembly 100. One damper assembly 260 is associated with the first condenser fan 110, and another damper assembly 260 is associated with the second condoner fan 112. Each damper assembly 260 is mounted or otherwise coupled to the shroud 114 that defines the first passage 120 and the second passage 122. Specifically, a first damper assembly 262 is disposed about and/or aligned with the first passage 120 associated with the first condenser fan 110, and a second damper assembly 264 is disposed about and/or aligned with the second passage 122 associated with the second condenser fan 112.

The damper assemblies 260 are each configured to adjustably block the respective passage 120, 122 with which it is associated in order to block air flow into the chamber 118 via the passages 120, 122 (e.g., in the direction 152). For example, each damper assembly 260 may be a backdraft damper having a frame 266, a plurality of blades 268 coupled to the frame 266. The frame 266 is coupled to the shroud 114 via an extension sleeve 270, such that the frame 266 is offset from the shroud 114. As will be appreciated, the damper assemblies 260 may each be configured to rest in a closed position whereby the plurality of blades 268 are in a closed configuration to occlude or block the respective passage 120, 122 with which it is associated. For example, in the absence of an air flow generated by the first condenser fan 110 (e.g., when the first condenser fan 110 is in an inactive or non-operating state), gravity acting on the plurality of blades 268 of the first damper assembly 262 may force the plurality of blades 268 into the closed position to occlude the first passage 120. Thus, when the first condenser fan 110 is not operating, the first damper assembly 262 in the closed position functions to block air flow (e.g., backflow air) into the chamber 118 via the first passage 120 in the direction 152. The second damper assembly 264 may operate similarly. That is, in the absence of an air flow generated by the second condenser fan 112 (e.g., when the second condenser fan 112 is in an inactive or non-operating state), gravity acting on the plurality of blades 268 of the second damper assembly 264 may force the plurality of blades 268 into the closed position to occlude the second passage 122 and block air flow through the second passage 122 and into the chamber 118.

When the first condenser fan 110 is in operation and is generating air flow, the air flow may force the plurality of blades 268 of the first damper assembly 262 into the open configuration shown in FIG. 8. In other words, the first condenser fan 110 may force the air flow through the first passage 120 and against the plurality of blades 268 to force the plurality of blades 268 (e.g., via a pressure differential across the plurality of blades 268 induced by the air flow) into the open configuration to expose the first passage 120 and enable discharge of the air flow from the chamber 118 via the first passage 120. The second damper assembly 264 may operate similarly in response to an air flow generated by the second condenser fan 112 when the second condenser fan 112 is in an active or operating state. It will be appreciated that the first and second damper assemblies 262, 264 may operate independently from one another. Thus, for example, when the first condenser fan 110 is not operating and the second condenser fan 112 is operating, the first damper assembly 262 may be in the closed configuration to block air flow into the chamber 118 via the first passage 120, and the second damper assembly 264 may be in the open configuration to enable discharge of air flow from the chamber 118 via the second passage 122. In this way, the damper assemblies 260 selectively block air flow (e.g., backflow air) through the first and second passages 120, 122 in the direction 152, which mitigates rotation (e.g., reverse rotation) of the first and second condenser fans 110, 112 in the clockwise direction 154 and reduces backflow of air recirculated between operational and non-operational condenser fans 110, 112. Further, as the damper assemblies 260 may be backflow dampers that operate via force of gravity, operation of the damper assemblies 260 may be automatic and implementation of the damper assemblies 260 may be simplified, which may reduce costs associated with operating and/or maintaining the condenser fan assembly 100.

Figure 9:
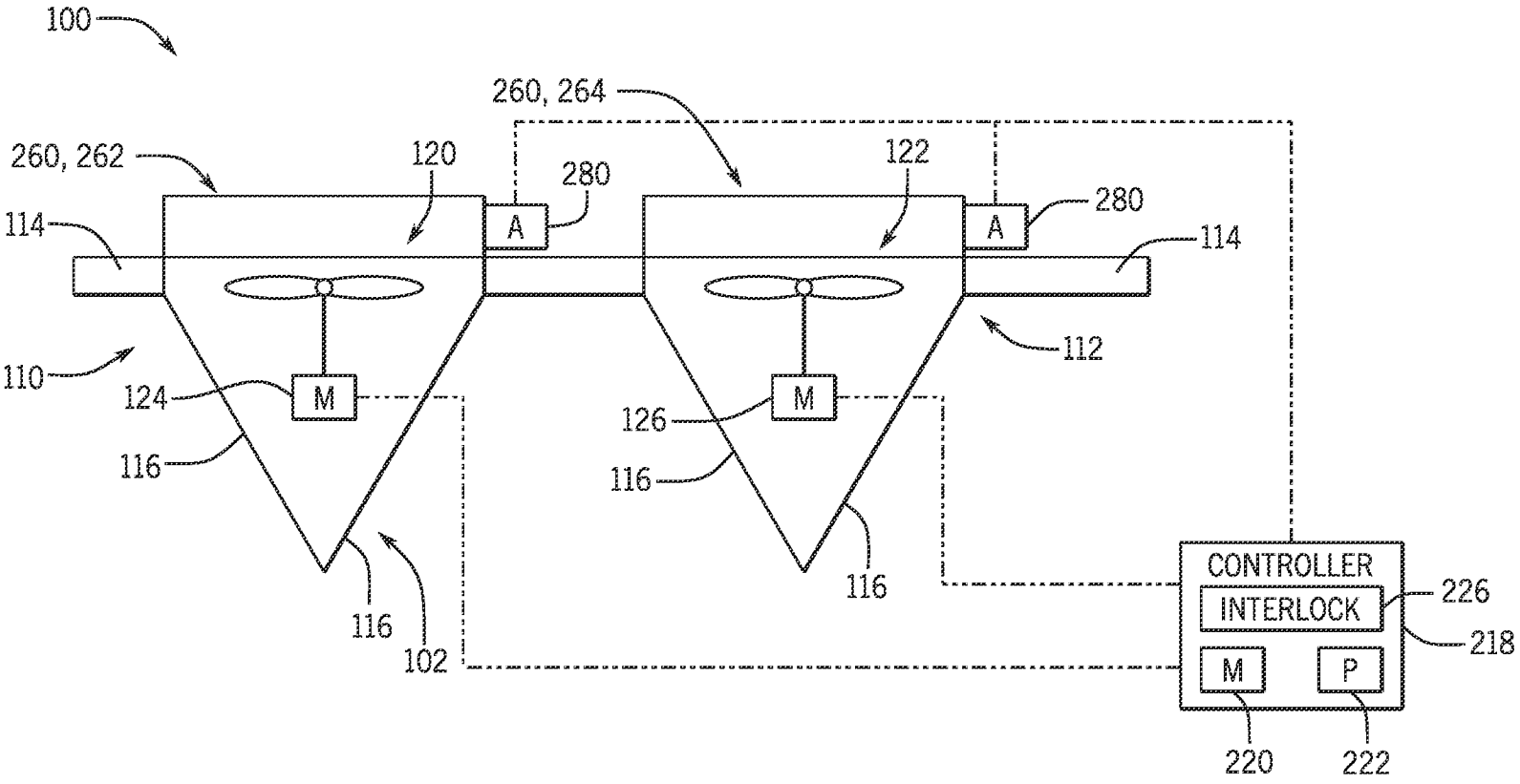
FIG. 9 is a schematic of an embodiment of a condenser fan assembly having a fan rotation restriction system, in accordance with an aspect of the present disclosure.

FIG. 9 is a schematic of an embodiment of the condenser fan assembly 100 including the fan rotation restriction system 160 with the damper assemblies 260. The illustrated embodiment includes similar elements and element numbers as the embodiment described above with reference to FIG. 8. Additionally, in the illustrated embodiment, each damper assembly 260 includes an actuator 280 configured to adjust positions of the respective plurality of blades 268 of the damper assembly 260. For example, the actuators 280 may be electromechanical actuators, magnetic actuators, pneumatic actuators, or other suitable actuators configured to adjust the positions of the plurality of blades 268.

As similarly described above, the actuator 280 may be configured to adjust the plurality of blades 268 of the damper assembly 260 based on an operating state of the condenser fan 110, 112 with which the damper assembly 260 is associated. For example, based on an indication (e.g., feedback, control signal, status signal, etc.) indicative of the first condenser fan 110 being in an inactive or non-operating state, the controller 218 may control the actuator 280 of the first damper assembly 262 to transition the plurality of blades 268 of the first damper assembly 262 to a closed position to occlude the first passage 120 and block air flow into the chamber 118 via the first passage 120. In this way, the first damper assembly 262 also mitigates reverse rotation of the first condenser fan 110 when the first condenser fan 110 is not operating. Based on an indication that operation of the first condenser fan 110 is desired, the controller 218 may operate the actuator 280 of the first damper assembly 262 to position the plurality of blades 268 in the open configuration to expose the first passage 120 and enable discharge of air flow from the chamber 118 via the first passage 120. The controller 218 may operate the actuator 280 of the second damper assembly 264 similarly. Further, as shown, the controller 218 may include the interlock 226 configured to operate in a manner similar to that described above. That is, the interlock 226 is configured to enable coordinated operation of the damper assemblies 260 and the first and second condenser fans 110, 112 to ensure that the damper assemblies 260 are not in the closed configuration when the condenser fan 110, 112 associated with the damper assembly 260 is in an operating or active state.

Technical effects of the fan rotation restriction system include a reduction in backflow of air through passages associated with condenser fans during non-operational periods of condenser fans. For example, the fan rotation restriction system may include a restrictor, which may have an actuator and a plunger, configured to engage with a condenser fan motor shaft (e.g., shaft sleeve) during non-operation of the condenser fan. The engagement between the restrictor and the shaft blocks reverse rotation of the inactive condenser fan, which may hinder a flow of backflow air through the passage associated with the inactive condenser fan. In additional or alternative embodiments, the fan rotation restriction system may include a damper assembly configured to occlude the passage associated with a condenser during non-operational periods of the condenser fan. With the passage occluded, backflow of air through the passage is blocked, which also reduces reverse rotation of the condenser fan. In addition, the fan rotation restriction systems disclosed herein may reduce a restart load on components of the motors of the condenser fans when the condenser fans resume normal operation after a period of inactivity.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A condenser fan assembly, comprising:

a fan shroud configured to couple to a condenser to define a chamber between the condenser and the fan shroud, wherein the fan shroud comprises a first passage and a second passage formed therein;

a first condenser fan and a first motor coupled to the first condenser fan, wherein the first motor is configured to drive rotation of the first condenser fan to discharge air from the chamber via the first passage;

a second condenser fan and a second motor coupled to the second condenser fan, wherein the second motor is configured to drive rotation of the second condenser fan to discharge air from the chamber via the second passage; and a damper assembly coupled to the fan shroud, wherein the damper assembly is disposed about and aligned with the first passage and is disposed external to the chamber, the damper assembly comprises a plurality of blades configured to transition between an open configuration and a closed configuration based on an operating state of the first condenser fan, the plurality of blades occludes the first passage in the closed configuration, and the plurality of blades exposes the first passage in the open configuration.

2. The condenser fan assembly of claim 1, comprising an additional damper assembly coupled to the fan shroud, wherein the additional damper assembly is disposed about and aligned with the second passage and is disposed external to the chamber, the additional damper assembly comprises an additional plurality of blades configured to transition between an additional open configuration and an additional closed configuration based on an additional operating state of the second condenser fan, the additional plurality of blades occludes the second passage in the additional closed configuration, and the additional plurality of blades exposes the second passage in the additional open configuration.

3. The condenser fan assembly of claim 2, comprising:

a first actuator of the damper assembly, wherein the first actuator is configured to transition the plurality of blades between the open configuration and the closed configuration; and a second actuator of the additional damper assembly, wherein the second actuator is configured to transition the additional plurality of blades between the additional open configuration and the additional closed configuration.

4. The condenser fan assembly of claim 3, comprising a controller communicatively coupled to the first actuator and the second actuator, wherein the controller configured to control operation of the first actuator and the second actuator independently of one another, control operation of the first actuator based on the operating state of the first condenser fan, and control operation of the second actuator based on the additional operating state of the second condenser fan.

5. The condenser fan assembly of claim 4, wherein the controller comprises an interlock configured to coordinate operation of the first actuator and the first condenser fan, and the controller is configured to instruct the first actuator to operate the damper assembly based on a determination by the interlock that the first condenser fan is in an active operating state.

6. The condenser fan assembly of claim 1, wherein the damper assembly is a backdraft damper configured to transition from the open configuration to the closed configuration via force of gravity.

7. The condenser fan assembly of claim 1, wherein the plurality of blades is configured to transition to the open configuration in response to a pressure differential across the plurality of blades.

8. The condenser fan assembly of claim 1, wherein the damper assembly comprises an actuator configured to transition the plurality of blades between the open configuration and the closed configuration.

9. The condenser fan assembly of claim 1, comprising a controller configured to operate the second motor to drive rotation of the second condenser fan with the plurality of blades in the closed configuration.

* * * * *